United States Patent [19]

Rhodes

[11] Patent Number: 4,459,827

[45] Date of Patent: Jul. 17, 1984

[54] GOLF BAG COOLER KIT

[76] Inventor: Duane C. Rhodes, 19 Yost St., Johnstown, N.Y. 12095

[21] Appl. No.: 496,006

[22] Filed: May 19, 1983

[51] Int. Cl.[3] ..... F25D 3/08

[52] U.S. Cl. ..... 62/457; 224/274; 224/919

[58] Field of Search ..... 224/274, 918, 919; 62/457, 371, 372, 529, 530

[56] References Cited

U.S. PATENT DOCUMENTS

| | | | |
|---|---|---|---|
| 1,095,023 | 4/1914 | Parkers | 62/457 |
| 1,648,565 | 11/1927 | Primley | 224/919 X |
| 2,730,151 | 1/1956 | Smith | 62/457 |
| 3,262,283 | 7/1966 | Taylor | 62/457 |
| 3,373,911 | 3/1968 | Kebelbeck | 224/27 X |
| 3,387,650 | 6/1968 | Hoffmann et al. | 62/457 |
| 4,266,407 | 5/1981 | Gibson | 62/457 |
| 4,280,336 | 7/1981 | Taylor | 62/457 |
| 4,295,345 | 10/1981 | Atkinson | 62/457 |

*Primary Examiner*—Lloyd L. King

*Attorney, Agent, or Firm*—Walter F. Wessendorf, Jr.

[57] ABSTRACT

Disclosed is a golf bag cooler kit for carrying and cooling canned beverages. A belt and mounting plate assembly is adjusted and tightened on a golf bag by means of belt straps. The cooler has compartments for receiving canned beverages. The cooler has a spring-clip assembly that is releasably engageable with the mounting plate to thereby mount the cooler on the golf bag. The spring-clip assembly is releasably locked together by cooperating interdigitation means.

10 Claims, 9 Drawing Figures

FIG. 1
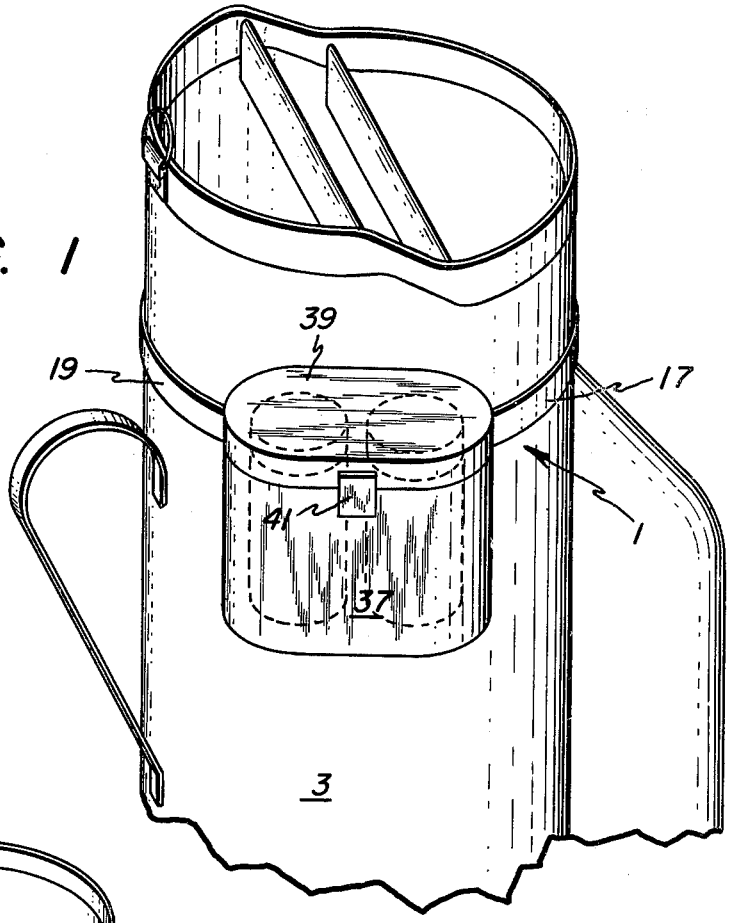
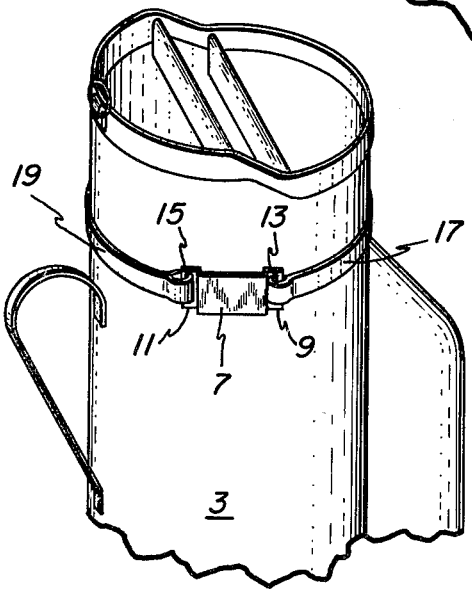
FIG. 2
FIG. 3
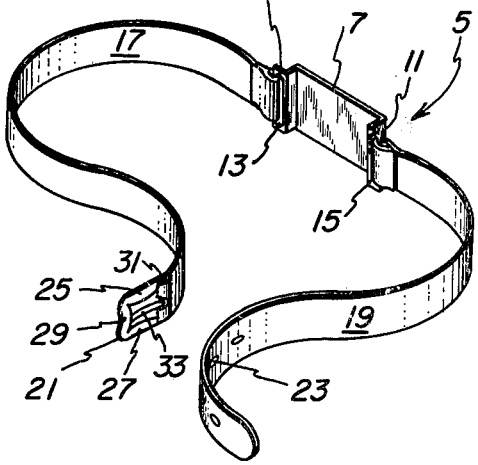

FIG. 4
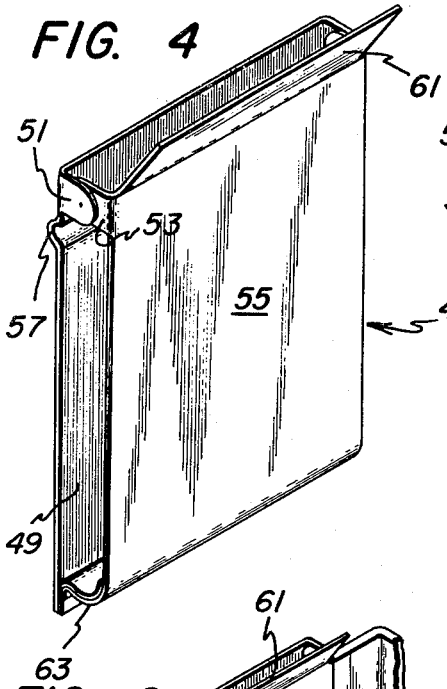
FIG. 5
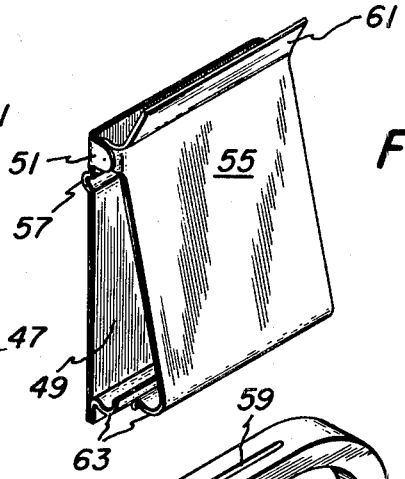
FIG. 7
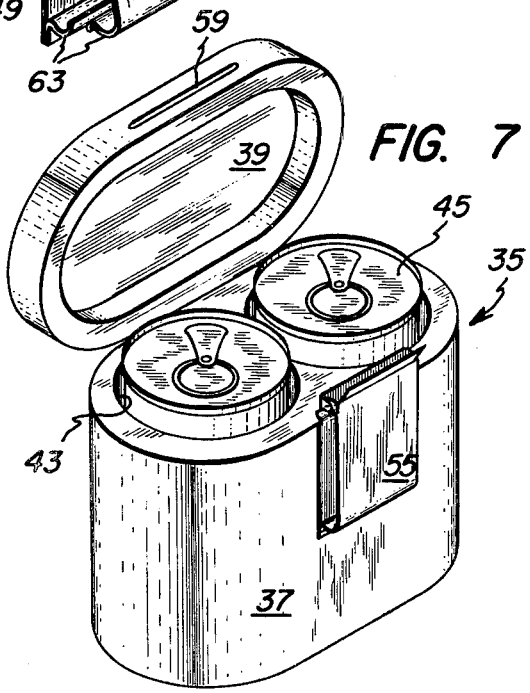
FIG. 6
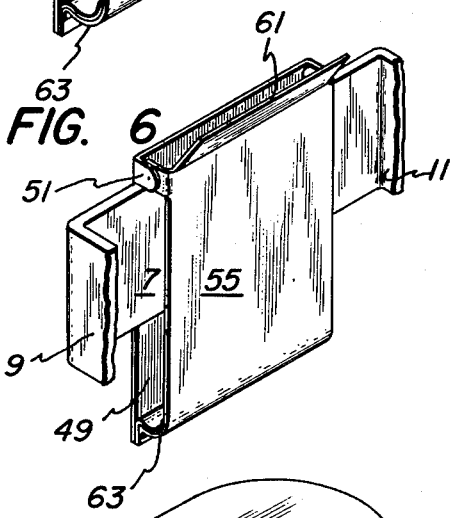
FIG. 8
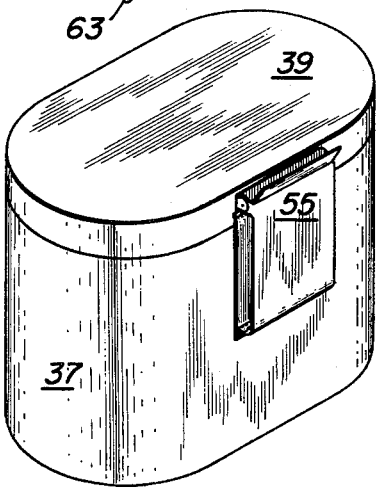
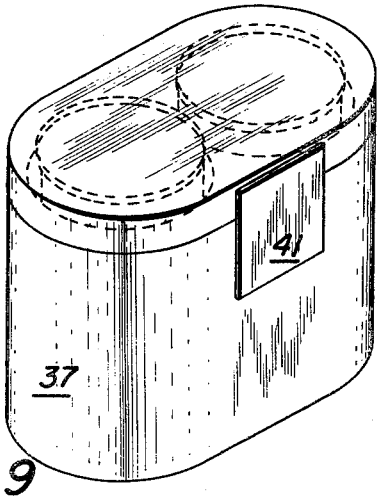
FIG. 9

GOLF BAG COOLER KIT

BACKGROUND OF THE INVENTION

1. Technical Field

This invention relates to a golf bag cooler kit whose cooler is adjustably mounted on a golf bag and with the cooler carrying and cooling canned beverages.

2. Background Art

The prior art, U.S. Pat. No. 1,095,023, discloses a cooling receptacle; U.S. Pat. No. 2,730,151 discloses a portable carrier; U.S. Pat. No. 3,262,283 discloses a refrigerating jacket; U.S. Pat. No. 3,387,650 discloses a receptacle for keeping the contents either hot or cold; U.S. Pat. No. 4,266,407 discloses a portable cooler; U.S. Pat. No. 4,280,336 discloses a portable cooler with food receptacle; U.S. Pat. No. 4,295,345 discloses a cooling container for canned beverages.

SUMMARY OF THE INVENTION

The object of this invention is to provide a golf bag cooler kit that can be removably mounted on a golf bag. The kit has a belt and mounting plate assembly that is adjustable and can be permanently mounted on a golf bag or can be removed at the option of the golfer. The cooler has a spring-clip assembly with interdigitation means whereby the cooler can be releasably locked on the mounting plate. The cooler has cylindrical compartments for holding canned beverages. The cooler holds "Blue Ice" packets. Hence, the golfer need only place the cooler in a freezer or freezing compartment. When the golfer is ready to play golf and wants to take along beverage to accommodate his thirst, he need only remove the cooler from the freezer, dispose two cans of beverage in the cylindrical compartments provided and releasably lock the spring-clip assembly on the mounting plate.

BRIEF DESCRIPTION OF THE DRAWINGS

This object and other objects of the invention should be discerned and appreciated with reference to the drawings, wherein like reference numerals refer to similar parts throughout the several views, in which:

FIG. 1 is an isometric view of a golf bag showing the cooler kit affixed thereto as in normal use;

FIG. 2 is an isometric view showing the belt and mounting plate assembly thereto attached;

FIG. 3 is a view of the belt and mounting plate assembly;

FIG. 4 is an enlarged view of the thumb-lock, spring-clip assembly in its locked position via its cooperating interdigitation means;

FIG. 5 shows the spring-clip assembly unlocked and open;

FIG. 6 shows the spring-clip assembly emplaced in locked position upon the mounting plate of the belt and mounting plate assembly;

FIG. 7 is a view of the cooler with beverage cans emplaced therein;

FIG. 8 shows the cooler in closed position; and

FIG. 9 is a reverse view of the cooler.

DESCRIPTION OF THE PREFERRED EMBODIMENT

To facilitate the understanding of the invention, a nomenclature list is herewith provided, to wit:

1 generally refers to the invention of the golf bag cooler kit
3 golf bag
5 belt and mounting plate assembly
7 mounting plate
9 L-shaped element of plate 7
11 L-shaped element of plate 7
13 slot in element 9
15 slot in element 11
17 belt strap
19 belt strap
21 belt buckle
23 hole in belt strap 19
25 upper bar of buckle 21
27 lower bar of buckle 21
29 left lateral bar of buckle 21
31 right lateral bar of buckle 21
33 tongue of buckle 21
35 cooler
37 bottom section or receptacle of cooler 35
39 top section or closure of cooler 35
41 fabric hinge
43 cylindrical compartment
45 beverage can
47 thumb-lock, spring-clip assembly
49 bracket plate of assembly 47
51 projecting ear of plate 49
53 projecting ear of spring clip 55
55 thumb-lock spring clip
57 detent of plate 49
59 recess in top cooler section 39
61 thumb tab of spring clip 55
63 camming interdigitation means of plate 49 and spring clip 55

In FIG. 1 of the drawings, reference numeral 1 generally refers to the invention of the golf bag cooler kit showing same affixed in normal use to a golf bag 3.

The golf bag cooler kit 1 has a belt and mounting plate assembly 5 comprising a mounting plate 7 offset from L-shaped elements 9 and 11 having slots 13 and 15 through which belt straps 17 and 19 are inserted, folded back and stitched together, or otherwise suitably secured. The belt straps 17 and 19 have a belt buckle 21 on one end and holes 23 in the other end, respectively. Buckle 21, of integral one-piece construction, has an upper bar 25, lower bar 27, left lateral bar 29 and right lateral bar 31. One end of belt strap 19 is conventionally looped around right lateral bar 31, folded back and stitched together, or otherwise suitably secured. Each of the holes 23 complementally receives therethrough in engaging relationship the distal end of tongue 33 in conventional mounting relationship with the left lateral bar 29.

The belt and mounting plate assembly 5 is disposed in the upper portion of golf bag 3 and is affixed thereto by appropriately training therearound belt straps 17 and 19, tightening and securing same together by operative engagement of tongue 33 with the appropriate one of the holes 23 in belt strap 19.

Cooler 35, made of polyethylene or other suitable material, has an insulated bottom section or receptacle 39 and an insulated top section or closure 39 which are hinged together by means of a fabric 41 suitably fixed to bottom sections 37 and top section 39. Cylindrical compartments 43, formed in bottom cooler section 37, freely receive therein the beverage can 45. Packets (not shown) of slow-thawing cooling gel, know as "Blue Ice" are appropriately disposed in the bottoms of cylindrical compartments 43.

A thumb-lock, spring-clip assembly 47 has a bracket plate 49 fixed or otherwise suitably secured to the bottom cooler section 37. Bracket plate 49 has projecting ears 51 in appropriate operative engagement with ears 53 projecting from a thumb-lock spring clip 55 to pivotally mount same. Bracket plate 49 has formed thereon a portion 57 projecting laterally inward that defines a detent engageable with and relievable within a complemental recess 59 formed in top cooler section 39 to releasably lock together top and bottom cooler sections 37 and 39. Thumb tab 61, upwardly and outwardly angled from spring clip 55, is thumb-engageable by the golfer to release and unlock the cooperating camming interdigitation means 63, as shown, of bracket plate 49 and spring clip 55 that releasably locks same together.

In use, "Blue Ice" packets are incorporated or disposed in the bottoms of the cylindrical compartments 43 and the cooler 35 is placed overnight in a freezer or freezing compartment. Beverage cans 45 are appropriately emplaced in the cylindrical compartments 43 and the top cooler section 39 is closed. Thumb tab 61 is appropriately manipulated to unlock the interdigitation means 63 of cooperating bracket plate 49 and spring clip 55. Theretofore, the belt and mounting place assembly 5 had been appropriately disposed, adjusted and emplaced on golf bag 3. Cooler 35 is then appropriately positioned and emplaced with respect to mounting plate 7 so that the thumb-lock, spring-clip assembly 47 can be positioned on mounting plate 7 and releasably locked together via its interdigitation means 63, as shown more discernably in FIG. 6.

Having thusly described my invention, I claim:

1. A golf bag cooler kit for carrying and cooling canned beverages; said kit comprising a belt and mounting plate assembly, and a cooler, said belt and mounting plate assembly having belt straps for training around a golf bag and means for adjustably tightening together said belt straps on said gold bag and securing same together, said cooler having compartments for receiving therein beverage cans, said belt and mounting plate assembly having a mounting plate, said cooler having a spring-clip assembly in fixed relationship therewith, said spring-clip assembly being engageable with said mounting plate to releasably lock together said spring-clip assembly and mounting plate, and to thereby releasably mount said cooler on the golf bag.

2. A golf bag cooler kit in accordance with claim 1, wherein said cooler has a bottom section and a top section, and wherein said bottom and top cooler sections have a cooperating hinge means for hinging together said bottom and top cooler sections.

3. A golf bag cooler kit in accordance with claim 1, wherein said cooler has bottom and top sections, wherein said spring-clip assembly has detent means, wherein said top cooler section has a recess, and wherein said detent means is operatively engageable with said recess to releasably lock together said top and bottom cooler sections.

4. A golf bag cooler kit in accordance with claim 1, wherein said spring-clip assembly comprises a bracket plate and a spring-clip, said cooler fixedly carrying said bracket plate, said bracket plate and spring clip being in pivotal mounting relationship, and said bracket plate and spring-clip having cooperating interdigitation means to releasably lock same together.

5. A golf bag cooler kit in accordance with claim 4, wherein said bracket plate and spring clip have projecting ears in operative engagement to establish such pivotal mounting relationship of said bracket plate and spring clip.

6. A golf bag cooler kit in accordance with claim 1, wherein said belt and mounting plate assembly has L-shaped elements, said L-shaped elements being offset from said mounting plate, said L-shaped elements having slots, said slots cooperating to receive therethrough and secure therewith said belt straps.

7. A golf bag cooler kit in accordance with claim 1, wherein said means for adjusting and tightening together said belt straps on said golf bag comprises a belt buckle carried on one belt strap and holes in the other belt strap, said belt buckle having a tongue whose distal end is engageable with one of said holes in said other belt strap.

8. A golf bag cooler kit in accordance with claim 2, wherein said spring-clip assembly has detent means, wherein said top cooler section has a recess, and wherein said detent means is operatively engageable with said recess to releasably lock together said top and bottom cooler sections.

9. A golf bag cooler kit in accordance with claim 4, wherein said spring clip has a thumb tab upwardly and outwardly angled therefrom, said thumb tab being manipulatable to release and unlock said interdigitation means.

10. A golf bag and cooler kit in accordance with claim 1, wherein said cooler has a bottom section and a top section, said bottom and top sections have cooperating hinge means hinging together said bottom and top cooler sections, wherein said spring-clip assembly has detent means, wherein said top cooler section has a recess, said detent means being operatively engageable with said recess to releasably lock together said top and bottom cooler sections, wherein said spring-clip assembly has a bracket plate and a spring clip, said bottom cooler section fixedly carrying said bracket plate, said bracket plate and spring clip having projecting ears in operative engagement establishing pivotal mounting relationship therebetween, said bracket plate and spring clip having cooperating interdigitation means to releasably lock same together.

* * * * *